US006689726B1

(12) United States Patent
Holt

(10) Patent No.: US 6,689,726 B1
(45) Date of Patent: Feb. 10, 2004

(54) CRYSTAL FORMATION REDUCTION IN LUBRICATING COMPOSITIONS

(75) Inventor: David Gary Lawton Holt, Medford, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

(21) Appl. No.: 10/049,973

(22) PCT Filed: Aug. 11, 2000

(86) PCT No.: PCT/EP00/07814

§ 371 (c)(1), (2), (4) Date: Jun. 17, 2002

(87) PCT Pub. No.: WO01/12761

PCT Pub. Date: Feb. 22, 2001

(30) Foreign Application Priority Data

Aug. 17, 1999 (GB) ..... 9919488

(51) Int. Cl.[7] ..... C10M 141/10

(52) U.S. Cl. ..... 508/442; 508/441; 508/485; 508/496; 508/498; 508/501; 508/506; 508/512; 508/571; 508/585

(58) Field of Search ..... 508/506, 512, 508/442

(56) References Cited

U.S. PATENT DOCUMENTS

| | | | | | |
|---|---|---|---|---|---|
| 3,965,017 | A | * | 6/1976 | Burnop et al. | 252/33.3 |
| 4,118,331 | A | * | 10/1978 | Jahnke | 252/32.7 E |
| 4,592,851 | A | * | 6/1986 | Stadtmiller et al. | 252/32.7 E |
| 4,652,385 | A | * | 3/1987 | Cohen | 252/48.6 |
| 5,681,506 | A | * | 10/1997 | Pragnell et al. | 252/405 |
| 5,972,852 | A | * | 10/1999 | Robson | 508/306 |
| 6,048,825 | A | * | 4/2000 | Markson et al. | 508/256 |
| 6,426,323 | B1 | * | 7/2002 | Sato et al. | 508/371 |
| 6,531,429 | B2 | * | 3/2003 | Fletschinger et al. | 508/433 |

* cited by examiner

*Primary Examiner*—Ellen M. McAvoy
(74) *Attorney, Agent, or Firm*—Norby L. Foss

(57) ABSTRACT

Lubricating oil formulations comprising base oil, sulfur-phosphorous anti-wear/extreme pressure agent and hindered phenol antioxidant, which combination of extreme pressure agent and hindered phenol antioxidant produces crystals and containing antioxidants, wherein the base oil is characterized as having a saturates content of 99 wt % or more is stabilized against crystal formation by the addition of a minor amount of high molecular weigh di- or polycarboxylic acid, or anhydride and an ester.

10 Claims, No Drawings

CRYSTAL FORMATION REDUCTION IN LUBRICATING COMPOSITIONS

This invention relates to lubricating oil based on base stocks having a saturates content of 99 wt % or more, preferably essentially 100% saturates and containing sulfur-phosphorus containing anti-wear/extreme pressure additives and hindered phenol antioxidants which combination of anti-wear/extreme pressure agent and hindered phenol antioxidant are prone to crystal formation, wherein the formation of crystals is reduced or eliminated by the use of a crystallization suppressant.

Lubricating oils containing various antioxidants or esters or fatty acid amides or sulfur-phosphorus additives in combination with phenols are known in the literature.

U.S. Pat. No. 5,167,844 is directed to a formulation comprising a base oil, at least one sulfur phosphorus containing compound, at least one amine and at least one hindered phenol.

JP 07034078 is directed to a hydraulic oil comprising mineral oil with an aromatic content of up to 1.5 wt % and a phenolic and aminic anti-oxidant, an alkenyl succinic acid imide rust inhibitor and a phosphoric acid type anti wear agent.

U.S. Pat. No. 5,590,483 is directed for lubricating a refrigeration system compressor using a break-in lubricating oil which is an ester type oil. Additionally an adipate, phthalate, azelate, sebacate, corrosion inhibitors such as alkali and/or alkaline earth metal sulfonate, antioxidants such as aminic or phenolic antioxidants and metal deactivators such as triazoles.

WO 97/14776 is directed to hydraulic oils comprising base oils combined with an amine antioxidant, a phenolic antioxidant, a phosphate ester and a fatty acid amide and/or polyhydric alcohol ester.

U.S. Pat. No. 5,773,393 is directed to a composition comprising at least 70 wt % oil of lubricating viscosity and an amount effective to inhibit metal corrosion of a soluble additive comprising (a) at least one amide compound of a mono- or polycarboxylic acid or reactive derivative thereof and (b) at least 0.5 equivalents of at least one primary or secondary amine per mole of amide provided that when (a) is an amide of a dicarboxylic acid and the amine is an alkanol amine the mixture contains more than 0.5 equivalent of the amine (b) per equivalent of the amide.

The present invention is directed to a lubricating oil formulation having a reduced potential for the formation of crystals comprising a major amount of a lubricating oil base stock having a saturates content of 99 wt % or more, preferably essentially about 100 wt % and a minor amount of additives comprising a mixture of sulfur-phosphorus containing anti-wear/extreme pressure additive, hindered phenol antioxidant, and a di- or polycarboxylic acid, anhydride or mixture thereof and an ester, and to a method for reducing crystal formation in lubricating oil formulations comprising base oil having saturates content of 99 wt % or more, preferably essentially about 100 wt %, and containing sulfur phosphorus anti-wear/extreme pressure additive and hindered phenolic anti-oxidant wherein the crystals are attributable to the interaction between the sulfur-phosphorus containing anti-wear/extreme pressure agent and the hindered phenol, by adding to said lubricating oil a minor effective amount of di- or polycarboxylic acid, anhydride or mixture thereof and an ester.

The lubricating base oil is any oil of lubricating oil viscosity having a saturates content of 99 wt % or more, preferably essentially 100 wt %.

Lubricating oils meeting this criterion are any natural mineral or petroleum based lubricating oils derived from crude oil, tar sands, shale oil, etc., such that they have a saturates content in the recited range, or a mixture of natural mineral or petroleum based lubricating oils in combination with poly-alpha olefins, isormerized wax or isomerized Fischer-Tropsch wax, the combination or mixture of such oils being characterized as having a saturates content of 99 wt % or more, preferably essentially 100 wt %. Saturates content, for the purpose of this invention, is a measure of the absence of aromatic species, and was determined using high pressure liquid chromatography (HPLC) according to method IP 368, except where otherwise expressly indicated.

The lubricating oil base stocks useful in the present invention have the typical lubricating oil viscosity, usually possessing kinematic viscosities in the range of about 1.5 to 500 $mm^2/s$ at 100° C., preferably 5 to 120 $mm^2/s$ at 100° C.

Mineral or petroleum based lubricating oil base stocks can be derived from paraffinic, naphthenic and mixed base crudes. Conventional refinery techniques include distillation, solvent and/or catalytic dewaxing, solvent extraction, hydrofinishing, hydrocracking, vis breaking, deasphalting, etc. Preferred mineral or petroleum based base stocks include white oils, hydrocracked or hydroisomerised base stocks.

Synthetic lubricating oils that can be used include esters of di- and tri-basic acids, reacted with linear or branched aliphatic alcohols such as $C_6$–$C_{15}$ alcohols, such as di-2-ethylhexyl sebacate, phthalates, esters of glycols such as $C_{13}$ oxo acid diester or tetraethylene glycol, or complex esters such as one formed from 1 mole of sebacic acid and 2 moles of tetraethylene glycol and 2 moles of 2-ethylhexanoic acid. Other synthetic oils that can be used include silicone oils, e.g., methyl polysiloxanes, etc.; polyglycol oils, e.g., those obtained by condensing butyl alcohol with propylene oxide; carbonate esters, e.g., the product of reacting $C_6$ oxo alcohol with ethyl carbonate to form a half ester followed by reaction of the latter with tetraethylene glycol, etc. The only requirement is that such oils be 100% saturated (that is, contain no unsaturation).

Other suitable oils are the polyol ester oils made by reacting an aliphatic polyol with carboxylic acid. Aliphatic polyols contain from 4 to 15 carbon atoms and has from 2 to 8 esterifiable hydroxyl groups. Examples of polyols are trimethylolpropane, pentaerythritol, dipentaerythritol, neopentyl glycol, tripentaerythritol and mixtures thereof. The carboxylic acid reactant is selected from aliphatic moncarboxylic acid or mixtures of aliphatic mono carboxylic acids or mixtures of aliphatic mono- and di-carboxylic acids. The carboxylic acids contain 4 to 12 carbons and include straight and branched chain carboxylic acids.

Included in the group of synthetic oils are those recovered from tar sands, shale oil, light hydrocarbons produced via, for example, the Fischer-Tropsch process for converting synthesis gas (CO and hydrogen) into hydrocarbons, wax isomerate oils produced by the catalytic hydroisomerization of natural petroleum waxes (i.e., slack wax) or synthetic waxes (i.e., Fischer-Tropsch waxes) or mixtures of such waxes. See U.S. Pat. No. 5,059,299 and U.S. Pat. No. 5,158,671 for description of wax isomerization and the oils produced thereby. Other synthetic oils include the polyolefins such as polybutene, polyisobutenes and especially the polyalphaolefins, i.e., fluids formed by the oligomerzation of at least one 1-alkane hydrocarbon having from 6 to 20 carbons, preferable 8 to 16 carbons, more preferably 8 to 12 carbons.

Regardless of the source of the oil, for the purposes of the present invention the lube oil base stock, be it a single oil or a mixture of oils, is characterized as having a saturates content of 99 wt % or more, preferably about 99.8 wt % or more.

Sulfur-phosphorus containing anti wear/extreme pressure additives are well known in the industry, and are materials containing both sulfur and phosphorus in the same materials. For the purposes of the present specification and appended claims, sulfur-phosphorus containing anti-wear/extreme pressure additives are those which react with hindered phenol antioxidant to produce crystals. Those skilled in the formulation art can readily determine without expenditure of significant or inventive effort, whether a particular sulfur-phosphorus containing anti-wear/extreme pressure agent reacts with hindered phenol antioxidant to produce crystals. If it does not, it is not within the scope of this invention. Any sulfur-phosphorus containing anti-wear/extreme pressure agent which is found to react with hindered phenol antioxidant to produce crystals in the subject base oil is within the invention and formulations containing such agent(s) and phenolic antioxidant will be beneficially affected as evidenced by reduction or elimination of crystal formation by the addition of the high molecular weight di- or polycarboxylic acid, anhydride or mixtures thereof and ester, as shown below, provided such carboxylic acid, anhydride or mixture thereof is used in an amount of at least about 0.0013 wt % for each 1 ppm phosphorus attributable to the sulfur-phosphorus containing anti-wear/extreme pressure agent, about 0.033 wt % or more ester is used for each 1 ppm phosphorus and the high molecular weight di- or poly carboxylic acid, anhydride or mixture thereof and the ester is employed in an ester to acid ratio of 25:1 by weight or higher.

Sulfur-phosphorus anti wear/extreme pressure additives are exemplified by, but not limited to, materials of the type:

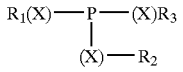

wherein $R_1$, $R_2$ and $R_3$ are independently hydrogen or hydrocarbyl provided at least one is hydrocarbyl so as to render the material oil soluble and X is sulfur.

The hydrocarbyl groups preferably contain form 1 to 40 carbons and are aromatic and/or aliphatic groups and include aryl, alkyl and alkaryl and aralkyl and heteroatom substituted aromatic and aliphatic group, the hetero atom substitutents being sulfur, nitrogen or oxygen substituted as such into the hydrocarbon selection or as sulfur, oxygen or nitrogen containing moiety, e.g., —$OR_y$, —SH, —$SO_2H$, —$N(R_y)_2$, —C—$R_xOR_y$,

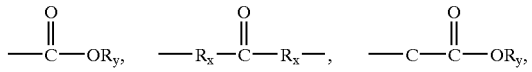

etc., and mixtures thereof substituted onto or into the hydrocarbon backbone, wherein $R_x$ is $C_1$–$C_{20}$ hydrocarbyl or hydrocarbylene group and $R_y$ is hydrogen or a $C_1$–$C_{20}$ hydrocarbyl or hydrocarbylene group.

Such sulfur-organo phosphorus containing anti wear/extreme pressure agent is typically used at a concentration of from about 2 ppm to 320 ppm phosphorus, preferably about 40 ppm to 200 ppm phosphorus, most preferably about 80 ppm to 130 ppm phosphorus.

An example of a sulfur phosphorus anti-wear/extreme pressure additive which has been found to react with hindered phenols to form crystals is a material is 2-ethylhexyl 10-ethyl-4-[[2-[(2 ethylhexyl)-oxyl]-2-oxoethyl] thio]-7-oxo-8-oxa-3,5-dithia-4-phospha tetradecanoate, CAS #83547-95-9. Based on the name and the CAS number, it is believed this material has the following structure:

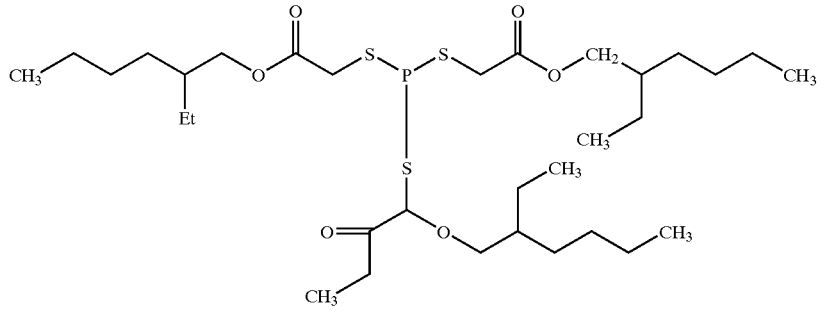

It must be noted that for the purposes of the present invention metal dihydrocarbyl dithio phosphates (metal DDP) or ashless DDP do not fall within the scope of the above definition of sulfur-phosphorus containing anti-wear/extreme pressure agents because it has been found that they do not form crystals when combined with hindered henols in base oils.

Hindered phenolic antioxidants are also quell known in the industry. Such materials include by way of example and not limitation 2,6-di-t-butyl phenol, 2,6-di-t-butyl alkylated phenol where the alkyl substituent is hydrocarbyl and contains between 1 and 20 carbon atoms, such as 2,6-di-t-butyl-4-methyl phenol, 2,6-di-t-butyl-4-ethyl phenol, etc., or 2,6-di-t-butyl-4-alkoxy phenol where the alkoxy substituent contains between 1 and 20 carbons such as 2,6-di-t-butyl-4-methoxyphenol; materials of the formula

II

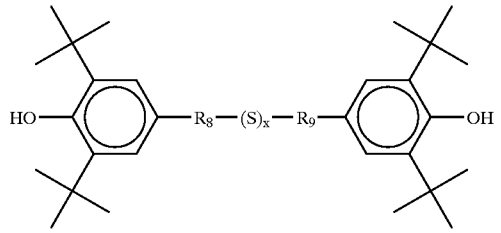

where X is zero to 5, $R_8$ and $R_9$ are the same or different and are $C_1$–$C_{20}$ hydrocarbyl which may contain oxygen or sulfur or be substituted with oxygen or sulfur containing groups; and materials of the formula

III

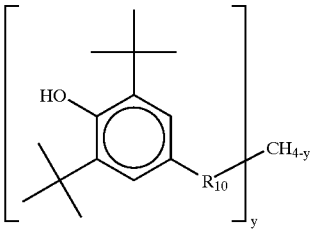

where y is 1 to 4 and $R_{10}$ is a $C_1$ to $C_{20}$ hydrocarbyl which may contain oxygen, sulfur or nitrogen or be substituted with oxygen, sulfur or nitrogen containing groups, such as 2,6 di tert butyl dimethyl amino p-cresol,

IV

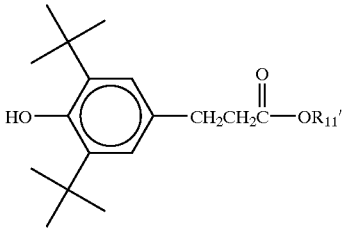

wherein it is believed $R_{11}$ is $C_8C_{17}$ (CAS #125643-61-0), and mixtures of such phenolic type antioxidants.

Preferably the phenolic antioxidant contains an ester group, such as in formula IV above.

Phenolic type antioxidants are typically used at a concentration of from about 0.01 to 2.0 wt %, preferably 0.1 to 1.0 wt %, most preferably 0.3 to 0.5 wt %, based on active ingredient.

In order to prevent or at least minimize the formation of crystals in lubricating oils based on base stock having 99 wt % or more saturates and containing a mixture of sulfur-organo phosphorus anti-wear/extreme pressure additive and phenolic antioxidant, wherein the sulfur-phosphorus containing anti-wear/extreme pressure agent is one which interacts with hindered phenol to produce crystals, a minor, crystal preventing effective amount of a high molecular weight carboxylic acid, anhydride or mixture thereof is added to the lubricating oil formulation, in combination with an ester. In those instances in which the 99 wt % or more saturates content oil already contains esters in an amount sufficient to satisfy the ester content range stated later in this specification it may be sufficient simply to add the aforesaid high molecular weight carboxylic acid, anhydride or mixture thereof which will be discussed in greater detail below.

The carboxylic acid anhydride or mixture thereof can be any high molecular weight acid di-, or polycarboxylic acid anhydride or mixture thereof of molecular weight of about 300 to 5000. Such acids, anhydrides or mixtures thereof include polyhydrocarbylene substituted di- or polycarboxylic acids wherein the poly hydrocarbylene group has a molecular weight in the range 300 to 5000, preferably 750 to 2000, most preferably 900 to 1000 (e.g., polyisobutylene) and wherein the carboxylic group is preferably succinic or maleic acid, anhydride or mixture thereof.

Poly hydrocarbylenes are homopolymer or interpolymers of polymerizable olefin group containing monomers having from 2 to 16 carbons. Interpolymers are those made using two or more different olefinic groups containing monomer including monomer such as styrenes. Polyhydrocarbylene homo and interpolymers are well known in the literature and to those skilled in the art and need not be further described herein.

Preferably the carboxylic acid anhydride or mixture thereof used is polyalkylene succinic or maleic acid, anhydride, or mixture thereof, most preferably polyisobutylene (PIB) succinic acid, anhydride or mixtures thereof wherein the PIB group has a molecular weight of about 900 to 1000.

Such high molecular weight carboxylic acids, anhydrides or mixtures thereof are employed in an amount in the range of about 0.0026 to 0.8 wt %, preferably about 0.08 to 0.4 wt %, most preferably about 0.12 to 0.24 wt %, based on active ingredients.

In general, from at least 0.0013 wt % of high molecule weight carboxylic acid, anhydride or mixture thereof is used for each 1 ppm from the sulfur-organo phosphorus anti wear/extreme pressure agent.

The ester can be any of the ester materials previously described as suitable synthetic oils. Esters such as phthalates and trimellitates can also be used.

About 0.033 wt % or more ester is used for each 1 ppm phosphorus, preferably about 0.042 wt % or more ester is used for each 1 ppm phosphorus from the sulflur-organo phosphorus anti-wear/extreme pressure agent.

The crystal suppressing combination of high molecular weight acid and/or anhydride and ester is employed in an ester to acid ratio of 25:1 or higher, preferably 32:1 or higher.

As previously stated, if the 99 wt % or more saturates content oil is itself a mixture of mineral oil or synthetic hydrocarbon oil, and ester, it may be enough merely to add a sufficient amount of high molecular weight acid/anhydride to the formulation to meet the aforesaid acid to sulfur-phosphorus anti-wear/extreme pressure additive ratio provided in doing so the ester/acid ratio also satisfies the 25:1 or more relationship. If insufficient ester is present an amount of ester sufficient to satisfy or reach the 25:1 or more ratio can be added to the formulation in order to achieve crystal formation suppression.

EXAMPLES

Example 1

This example (Table 1) is present to demonstrate the necessity of using both the high molecular weight carboxylic acid, anhydride or mixture thereof and an ester to suppress/eliminate the formation of crystals in oils of 99 wt % or more saturates content when using a mixture of sulfur phosphorus anti wear/extreme pressure agent and hindered phenol antioxidant. It is noteworthy that when the oil is of louver saturates content, the use of the high molecular weight carboxylic acid, anhydride or mixture thereof by itself is sufficient to suppress/eliminate crystal formation, but that the use of an ester by itself in the same lower saturates content oil is not sufficient to control crystal formation. Conversely in the case of 99 wt % or higher saturates content oil, the high molecular weight carboxylic acid, anhydride or mixture thereof by itself is not capable of controlling crystal formation.

TABLE 1

| | | | | | | | Crystals at 3 months |
|---|---|---|---|---|---|---|---|
| Base oil (1) | + | 0.55 wt % S-P anti-wear/extreme pressure agent (2) | + | 0.4 wt % hindered phenol (3) | + | 0.16 wt % PIBSA (4) | No |
| Base oil (5) | + | 0.55 wt % S-P anti-wear/extreme pressure agent (2) | + | 0.4 wt % hindered phenol (3) | + | 0.16 wt % PIBSA (4) | No |
| Base oil (6) | + | 0.55 wt % S-P anti-wear/extreme pressure agent (2) | + | 0.4 wt % hindered phenol (3) | + | 0.16 wt % PIBSA (4) | Cloudy |
| Base oil (7) | + | 0.55 wt % S-P anti-wear/extreme pressure agent (2) | + | 0.4 wt % hindered phenol (3) | + | 0.16 wt % PIBSA (4) | Cloudy |
| Base oil (8) | + | 0.55 wt % S-P anti-wear/extreme pressure agent (2) | + | 0.4 wt % hindered phenol (3) | + | 0.16 wt % PIBSA (4) | Cloudy |
| Base oil (9) (10) | + | 0.55 wt % S-P anti-wear/extreme pressure agent (2) | + | 0.4 wt % hindered phenol (3) | + | Esters (11) | Yes |
| Base oil (8) | + | 0.55 wt % S-P anti-wear/extreme pressure agent (2) | + | 0.4 wt % hindered phenol (3) | + | — | Yes |
| Base oil (8) | + | 0.55 wt % S-P anti-wear/extreme pressure agent (2) | + | 0.4 wt % hindered phenol (3) | + | Ester (12) (3 wt %) | Yes |
| Base oil (8) | + | 0.55 wt % S-P anti-wear/extreme pressure agent (2) | + | 0.4 wt % hindered phenol (3) | + | Ester (12) (5 wt %) | Yes |
| Base oil (8) | + | 0.55 wt % S-P anti-wear/extreme pressure agent (2) | + | 0.4 wt % hindered phenol (3) | + | Ester (12) (10 wt %) | Yes |
| Base oil (8) | + | 0.55 wt % S-P anti-wear/extreme pressure agent (2) | + | 0.4 wt % hindered phenol (3) | + | PIBSA (0.8 wt %) | Yes |
| Base oil (8) | + | 0.55 wt % S-P anti-wear/extreme pressure agent (2) | + | 0.4 wt % hindered phenol (3) | + | Ester (12) (3 wt %) + PIBSA (0.16 wt %) | Yes |
| Base oil (8) | + | 0.55 wt % S-P anti-wear/extreme pressure agent (2) | + | 0.4 wt % hindered phenol (3) | + | Ester (12) (5 wt %) + PIBSA (0.16 wt %) | No |

(1) Solvent refined base oil, about 88% saturates 150 SN oil.
(2) Sulfur phosphorus extreme pressure agent CAS #83547-95-9 which is 60% sulfur-phosphorus component active ingredient (also contained $C_4$–$C_8$ diphenyl amine as balance of additive). The fully formulated lubricant has a phosphorus content of 120 ppm by weight, measured according to standard test ASTM D5185-97, attributable to the sulfur-phosphorus extreme pressure agent (which is the sole phosphorus containing component contained in the formulation)
(3) 100% active ingredient, CAS #125643-61-0.
(4) PIBSA is polyisobutylene succinic anhydride having a polyisobutylene molecular weight of about 950.
(5) Hydrocracked 90 N, about 92% saturates.
(6) 150 N FDA A grade white oil, 100% saturates.
(7) Hydrocracked 150 N, about 99.9% saturates.
(8) PAO-6, 100% saturates
(9) base oil, a 50/50 mixture of 150 N (88% saturates) and 400 N (about 78% saturates).
(10) Formulation also contained pour point depressant, antirust.
(11) Esters tested were di iso nonyl phthalate at 0.05 to 4 wt %; di iso tridecyl adipate at 0.1 to 0.5 wt %; $C_6$—$C_{13}$ phthalate at 0.5 wt %. None were effective alone at eliminating crystal formation during the three month test period.
(12) Di iso nonyl phthalate

What is claimed is:

1. A lubricating oil of reduced crystal formation potential, said formation potential attributable to the interaction of sulfur phosphorus containing anti-wear/extreme pressure agents and hindered phenolic autioxidants, comprising a major amount of a base oil of lubricating viscosity and having a saturates content of 99 wt % or more, and a minor amount of additives comprising a mixture of sulfur-phosphorus containing anti-wear/extreme pressure additive, a hindered phenol antioxidant, a high molecular weight di- or poly-carboxylic acid, anhydride or mixture thereof and an ester provided at least 0.0013 wt % high molecular weight carboxylic acid, anhydride or mixture thereof is present for each 1 ppm phosphorus attributable to the sulfur phosphorus containing anti-wear/extreme pressure agent, about 0.033 wt % or more ester is present for each 1 ppm phosphorus and the combination of high molecular weight acid, anhydride or mixture thereof and ester is employed in an ester to acid ratio of 25:1 by weight or higher.

2. The lubricating oil of claim 1 wherein the sulfur-phosphorus anti-wear/extreme pressure agent is in an amount sufficient to provide about 2 ppm to 320 ppm phosphorus, the hindered phenol antioxidant is at a concentration of from about 0.01 to 2.0 wt % based on active ingredient and the high molecular weight di- or poly-carboxylic acid is at a concentration of in the range of about 0.0026 to 0.8 wt % based on active ingredient, and the ester is at a concentration of about 0.042 wt % or more ester for each 1 ppm phosphorus.

3. The lubricating oil of claim 2 wherein the sulfur-phosphorus containing anti-wear/extreme pressure agent is in an amount sufficient to provide from 40 ppm to 200 ppm phosphorus.

4. The lubricating oil claim 3 wherein the sulfur-phosphorus containing anti-wear/extreme pressure agent is in an amount sufficient to provide from 80 ppm to 130 ppm phosphorus.

5. The lubricating oil of any preceding claim wherein the hindered phenol is at a concentration of about 0.1 to 1.0 wt % based on active ingredient.

6. The lubricating oil of claim 5 wherein the hindered phenol is at a concentration of about 0.3 to 0.5 wt % based on active ingredient.

7. The lubricating oil of claim 6 wherein the high molecular weight di- or poly-carboxylic acid, anhydride or mixture thereof is at a concentration of about 0.08 to 0.4 wt % based on active ingredient.

8. The lubricating oil of claim 7 wherein the high molecular weight di- or poly-carboxylic acid, anhydride mixture thereof is a polyhydrocarbylene substitued di- or poly-carboxylic acid, anhydride or mixture thereof wherein the polyhydrocarbylene group has a molecular weight in the range 300 to 5,000.

9. The lubricating oil of claim 8 wherein the high molecular weight di- or poly-carboxylic acid, anhydride or mixture thereof is polyisobutylene succinic or maleic acid, anhydride or mixture thereof wherein the poly iso butylene has a molecular weight on the range 900 to 1,000.

10. A method for reducing crystal formation in lubricating oil containing a mixture of sulfur phosphorus anti-wear/extreme pressure agent and hindered phenols antioxidant wherein the sulfur-phosphorus anti-wear/extreme pressure agent interacts with the phenolic antioxidant to produce crystals, such method comprising adding to a major amount of a base oil of lubricating viscosity having a saturates content 99 wt % or more, a minor amount of additives comprising a sulfur-phosphorous containing anti-wear/extreme pressure agent a hindered phenol antioxidant and a high molecular weight di- or poly-carboxylic acid, anhydride or mixture thereof and an ester provided at least 0.0013 wt % of the high molecular weight di- or poly-carboxylic acid, anhydride or mixture thereof is used for each 1 ppm phosphorus attributable to the sulfur-phosphorus containing anti-wear/extreme pressure agent, about 0.033 wt % or more ester is present for each 1 ppm phosphorus and the combination of high molecular weight di- or poly-carboxylic acid, anhydride or mixture thereof and ester is employed in an ester to acid ratio of 25:1 by weight or higher.

* * * * *